US008342115B2

(12) United States Patent
Lindström

(10) Patent No.: US 8,342,115 B2
(45) Date of Patent: Jan. 1, 2013

(54) DEVICE FOR A SAILING BOAT

(75) Inventor: Mathias Lindström, Göteborg (SE)

(73) Assignee: Seldén Mast AB, Västra Frölunda (SE)

( * ) Notice: Subject to any disclaimer, the term of this patent is extended or adjusted under 35 U.S.C. 154(b) by 268 days.

(21) Appl. No.: 12/678,460

(22) PCT Filed: Sep. 22, 2008

(86) PCT No.: PCT/SE2008/051056

§ 371 (c)(1),
(2), (4) Date: Mar. 19, 2010

(87) PCT Pub. No.: WO2009/041898

PCT Pub. Date: Apr. 2, 2009

(65) Prior Publication Data

US 2010/0192827 A1 Aug. 5, 2010

(30) Foreign Application Priority Data

Sep. 26, 2007 (SE) ..... 0702153

(51) Int. Cl.
*B63H 9/04* (2006.01)
*F16G 11/00* (2006.01)
*B63B 21/04* (2006.01)

(52) U.S. Cl. ..... 114/102.21; 114/102.18; 114/218; 24/133

(58) Field of Classification Search ..... 114/218, 114/102.2, 102.12, 102.17–102.19, 199, 114/102.21; 182/5; 254/269–273, 390, 391; 74/575, 577, 527, 529, 531, 532; 242/388.3, 242/388.9; 24/133
See application file for complete search history.

(56) References Cited

U.S. PATENT DOCUMENTS 5,319,997 A 6/1994 Galloway et al.
(Continued)

FOREIGN PATENT DOCUMENTS

DE 2602092 A1 3/1977
(Continued)

OTHER PUBLICATIONS

Swedish Patent Office, Int'l Search Report in PCT/SE2008/051056, Dec. 11, 2008.

(Continued)

*Primary Examiner* — Lars A Olson
*Assistant Examiner* — Anthony Wiest
(74) *Attorney, Agent, or Firm* — Potomac Patent Group PLLC

(57) ABSTRACT

The invention relates to a device (10) at a cleat (1) for a sailing boat in order to provide detachable locking of the line (3) to a sail, a rig or the like, where the line (3) runs over a sheave (2) on an elevated level and having cleat (1) for locking the line (3) situated at a distance from the deck of the boat. According to the invention, the line (3) is arranged to run over a sheave (2), which is provided with ratchet back stop (5). The line (3) is in that connection arranged to directly co-operate with a movably actuatable mechanism (14), which is arranged to activate the ratchet back stop (5). The mechanism (14) is formed of at least one pivotably mounted main arm (4), and said mechanism (14) is arranged to activate the ratchet back stop (5), the mechanism (14) being arranged to, upon fixed load of the line (3, 3A), which goes down to deck and by means of which the sail (9) is hoisted, actuate the main arm (4) to connect ratchet back stop function (5) on the sheave (2) and in that connection prevent the pulling backwards (7) of the line toward the sail (9).

10 Claims, 6 Drawing Sheets

U.S. PATENT DOCUMENTS

Figure 1:
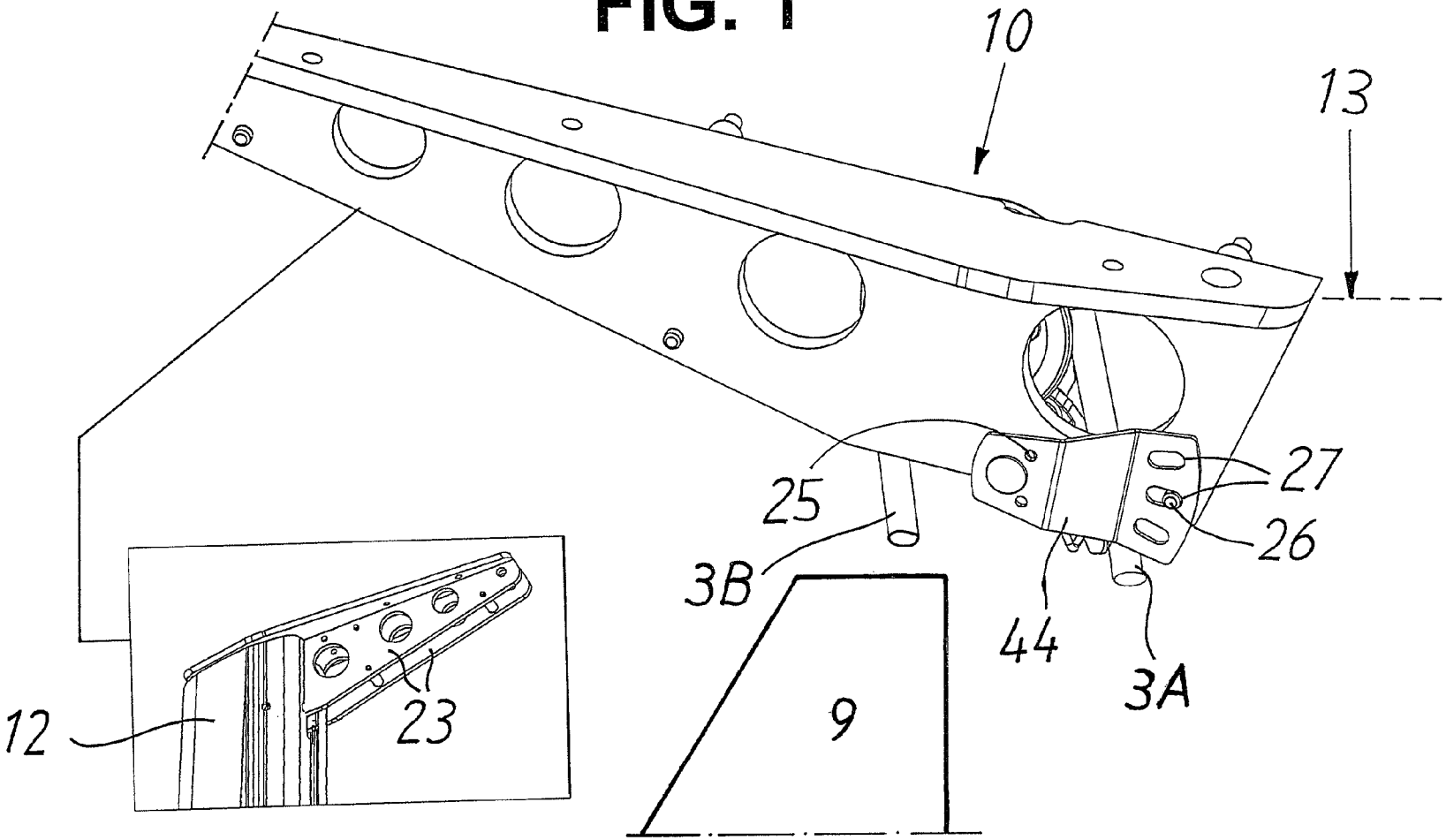

| | | | | |
|---|---|---|---|---|
| 5,511,447 | A * | 4/1996 | Galloway et al. | 74/577 S |
| 7,658,264 | B2 * | 2/2010 | Mauthner | 182/5 |

FOREIGN PATENT DOCUMENTS

| | | | |
|---|---|---|---|
| GB | 1069660 | A1 | 5/1967 |
| WO | 99/56035 | A1 | 11/1999 |

OTHER PUBLICATIONS

Swedish Patent Office, Int'l Prelim. Report on Patentability in PCT/SE2008/051056, Apr. 8, 2010.

* cited by examiner

FIG. 5
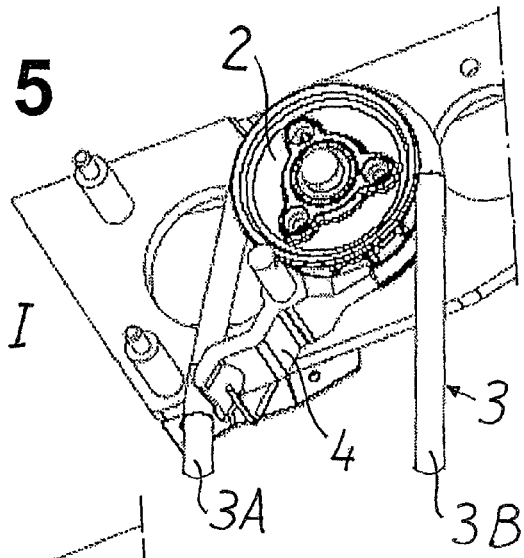
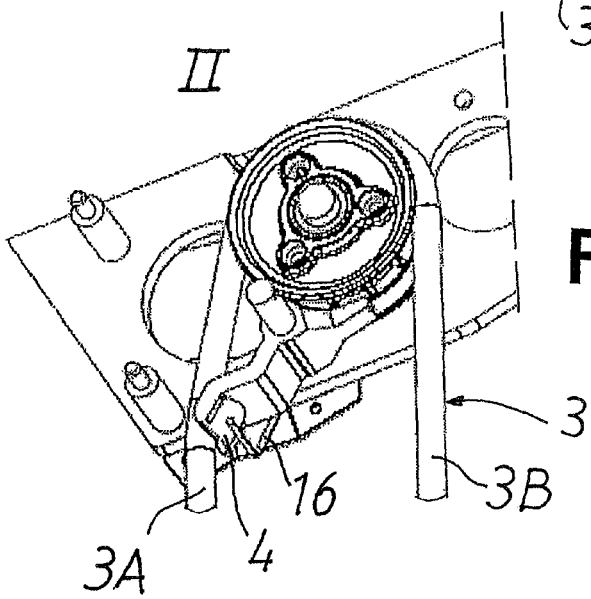
FIG. 6
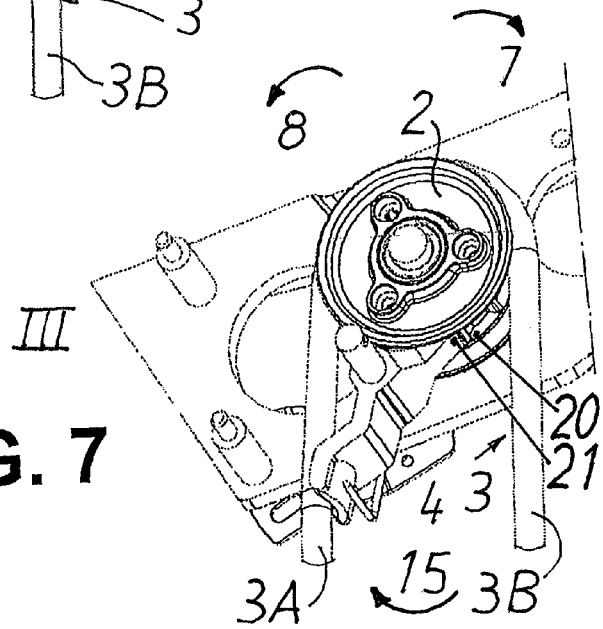
FIG. 7

DEVICE FOR A SAILING BOAT

The present invention relates to a device at cleat for sailing boat for detachable locking of line to sail, rig and the like, where the line runs over a sheave on an elevated level and having cleat for locking the line situated at a distance from the deck of the boat.

BACKGROUND

In order to handle sail and rig on a sailing boat, lines of different types are usually used. Examples of functions that are guided by means of lines are:

Hoisting sail
Sheeting of sail
Taking in sail
Stretching sail, e.g., outhaul and downhaul
Stretching running rig, e.g., yang block and backstays.

Common denominator for all types of lines is that they stretch more or less during load. In many applications, this is a disadvantage. As an example, hoisting sail may be mentioned:

A sail is hoisted by means of a line (halyard), which runs through a sheave in the upper part of the mast. Persons hoisting the sail are on deck level. The sail is hoisted until it is in top or until it has reached a certain predetermined level, e.g., upon taking in. Normally, a winch is required in order to get sufficient stretch of the halyard and thereby also of the leading edge of the sail. When the sail has been hoisted to the desired height, the halyard is locked on deck level, usually in a so-called rope-clutch. During sailing the halyard will be exposed to additional load because of the influence of the wind on the sail. This extra load entails that the halyard stretches, which in turn leads to the sail sliding down. This may in turn lead to undesired folds in the sail and thereby impaired aerodynamics, which results in a deterioration of the sailing properties of the boat.

Traditional sail canvas stretches relatively much in comparison with more modern racing cloths, which entails that when the leading edge is tensioned, it stretches approximately as a very stiff rubber elastic. When then the sail slides down due to the halyard stretching, the sail contracts somewhat, and no folds arise due to the remaining tension of the leading edge.

In the last few years, the development is toward more and more unelastic sail canvas—this in order to get sails with more stable shape. When an unelastic sail slides down due to the halyard stretching, folds are formed along the leading edge of the sail when the tension of the leading edge disappears. In order to compensate for this, it is necessary to afterstretch the halyard. The alternative is to haul-in in the downhaul (Cunningham). However, upon additional wind increase, the halyard will be exposed to additional load, which entails that the halyard stretches additionally, which in turn results in the sail sliding down additionally, which in turn results in new folds in the sail and so on.

In order to reduce the problems of unelastic sails, more unelastic lines have been developed. A traditional polyester line stretches approx. 3-4% (upon work load) while a modern line manufactured from e.g., SPECTRA™ or VECTRAN™, shows strain values of down to 1%. However, these lines are very expensive and do not solve the problem, since a strain of 1% yet corresponds to 150 mm strain if the line is 15 meters.

EXISTING TECHNIQUE

In order to avoid that the sail slides down according to the example above, there are different types of halyard cleats. The principle is that the halyard is locked in the top instead of on deck level in order to in such a way escape the problem of the strain of the line. Since the distance between the locking point and the fixing point in the upper part of the sail is small, the strain will be negligible.

By the fact that the halyard after locking entirely can be unloaded, also the compression of the mast is decreased.

Halyard Cleats for Smaller Boats

A usual way to lock the halyard in the top of the mast of dinghies and smaller boats is by means of a ball or the like, which is hooked on a single ratchet placed in the top of the mast. However, it is often problematic both to hook on and unhook the ratchet since this is placed in the top of the mast and hooking on and unhooking is carried out by angling out and pull and let go, respectively, in the halyard down on deck level.

Halyard Cleats Having Jaws

Another variant of halyard cleat, which is more common in greater boats, operates in the following way:

On the aft side of mast, a rail is running and on the same rail, a number of carriages (mast track slides) are running in which the sail is fixed. The halyard is fastened in the uppermost mast track slide. This mast track slide is strengthened and provided with spring-loaded jaws, which lock in holes of the rail when the sail has been hoisted to the top or to another predetermined level. Then, the halyard can be entirely unloaded. In order to get the sail down, the halyard is stretched up and the jaws are loosened by means of a separate trigger line, which goes down to deck level. This arrangement requires many parts. If the ratchet sheaves or if the trigger line "kinks", it may be difficult or impossible to get the sail down. It may then be required that the crew go up in the mast and detaches the locking manually.

Halyard Cleats Having Rope-Clutch in the Top

A third variant of halyard cleat is that the halyard is led through a wedge clutch (a so-called jammer), which is placed in the top. The halyard locks automatically thanks to the spring-loaded wedge of the clutch and the halyard can then be entirely unloaded—In order to get the sail down, the halyard is hauled-in in order for the wedge to be released and then the wedge is kept in extended state by means of a separate trigger line, which goes down to deck. If the trigger line or the wedge "kinks", it may also on this occasion be difficult or impossible to get the sail down. It may then also be required that the crew go up in the mast and detaches the ratchet manually also on this occasion.

Ratchet Blocks

For the unloading of sheet in dinghies and smaller boats, ratchet block or auto-ratchet block is often used.

A ratchet block is a block having ratchet back stop as well as having a sheave, which has a wedge-shaped notch for the line or grooves or a combination of wedge-shape and grooves. Thanks to the ratchet back stop and the friction against the line which is provided by wedge-shape and/or grooves, the yachtsman manages to put his weight firmly against great sheet loads without needing to lock the line in a cleat or the like.

Auto-Ratchet Block

An auto-ratchet block works in the same way as a usual ratchet block when the line is loaded. However, when the line successively is unloaded, the ratchet function releases and the sheave transforms into being moved freely in both directions. The ratchet function is controlled by how much load that is put on the block. Upon high loads, the holding force is overcome in an internal spring and the sheave is allowed to be displaced in the direction of force so that the distance between sheave and block attachment increases. By this displacement, the ratchet back stop is obtained to go in engagement in an inner gear rim, which is a part of the proper sheave. See, among others, U.S. Pat. No. 5,511,447 A and U.S. Pat. No. 5,319,997 A.

However, because of the ratchet mechanism being placed inside the block, the load holding capacity becomes limited.

Therefore, the main object of the present invention is primarily to provide a device, which among other things solves the problems and the disadvantages mentioned above and obtain a reliable cleat, which works in all types of weather.

Said object is attained by means of a device according to the present invention, which essentially is characterized in that the line is arranged to run over a sheave, which is provided with ratchet back stop, that the line is arranged to directly co-operate with a movably actuatable mechanism, which is formed of at least one pivotably mounted main arm, that said mechanism is arranged to activate the ratchet back stop, the mechanism being arranged to, upon fixed load of the line, which goes down to deck and by means of which the sail is hoisted, actuate the main arm to connect ratchet back stop function on the sheave and in that connection prevent the pulling backwards of the line toward the sail.

Figure 2:
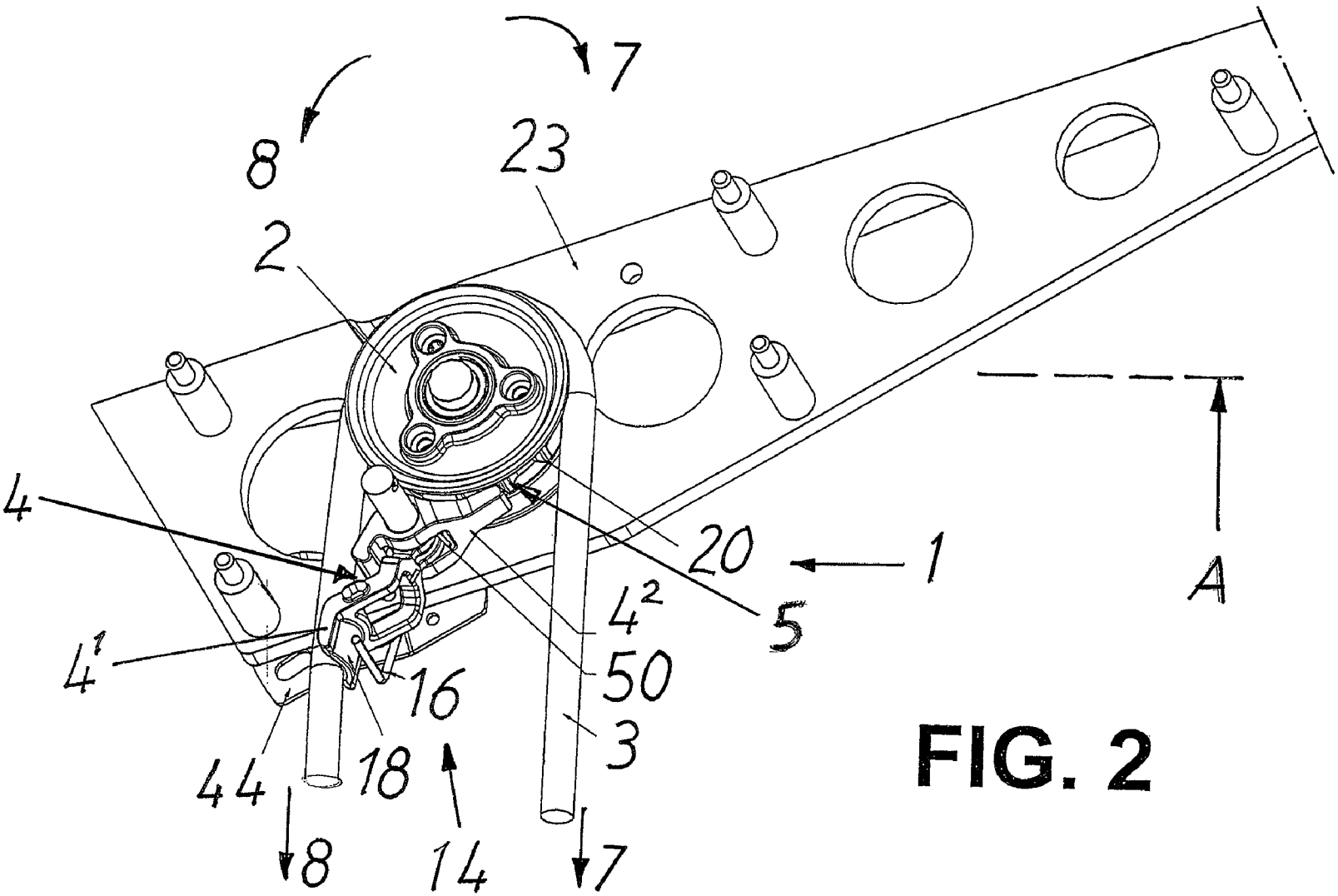
Figure 3:
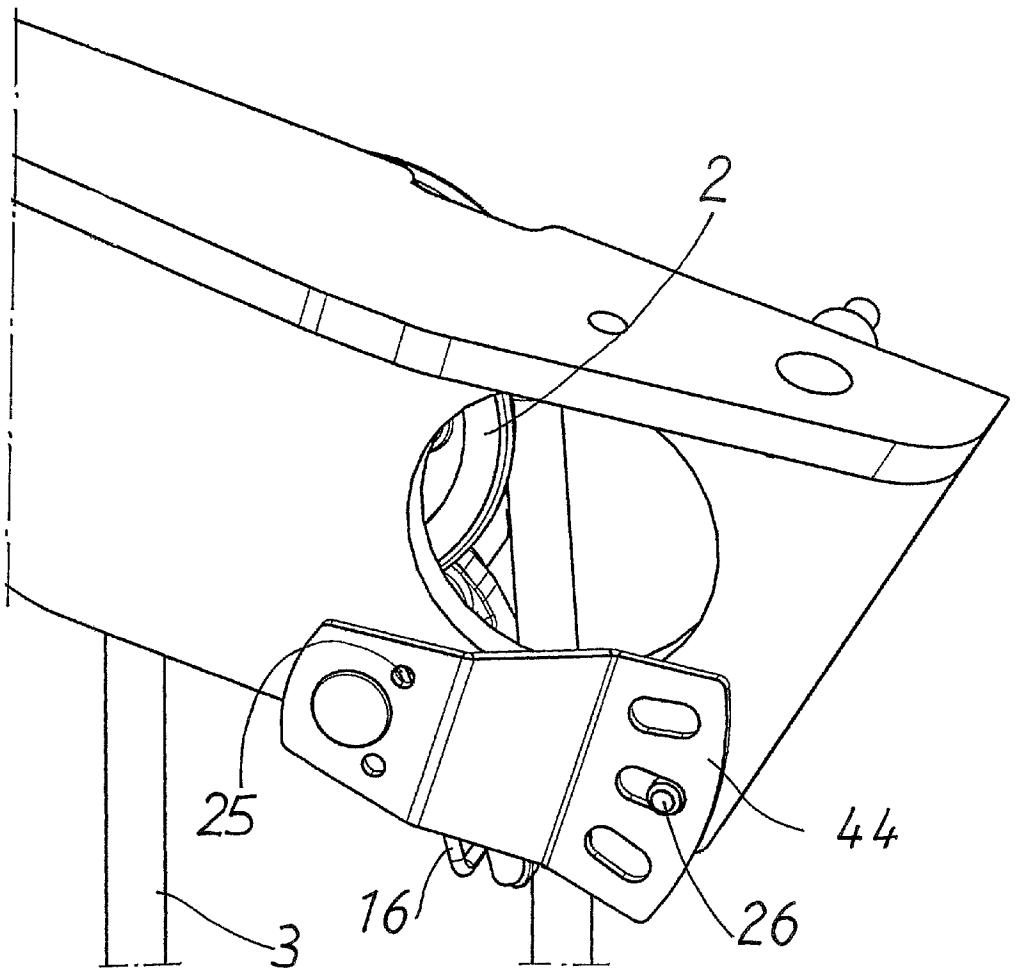
Figure 4:
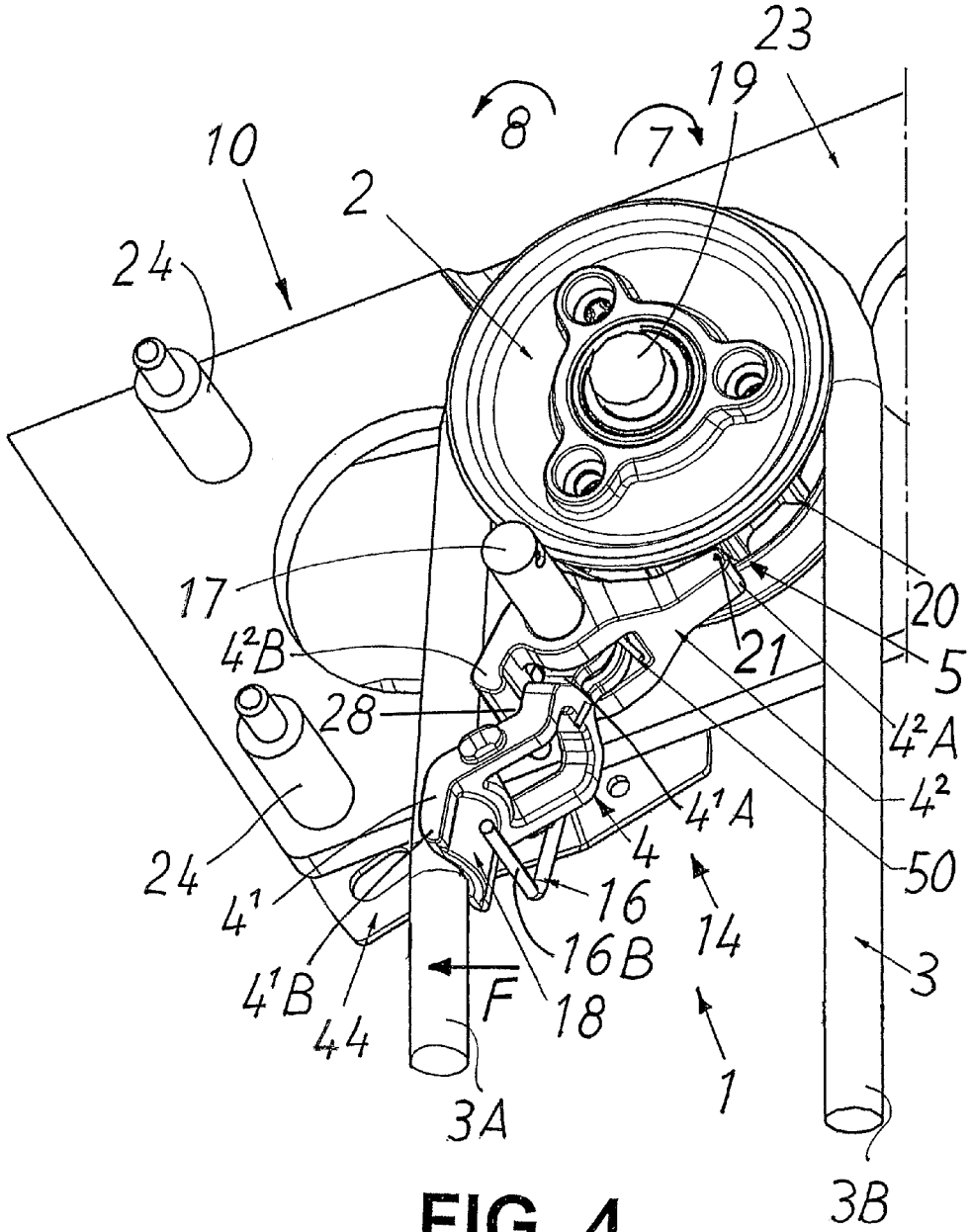
Figure 10:
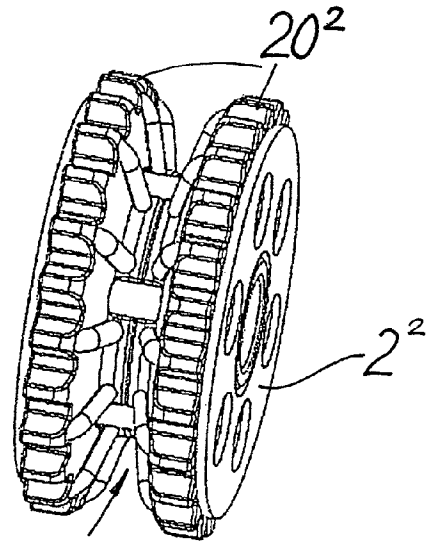
Figure 9:
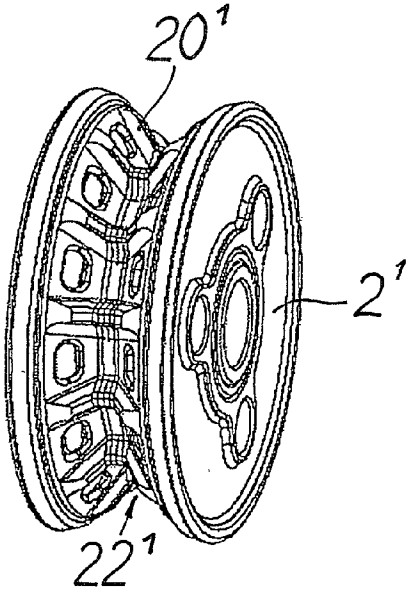
Figure 8:
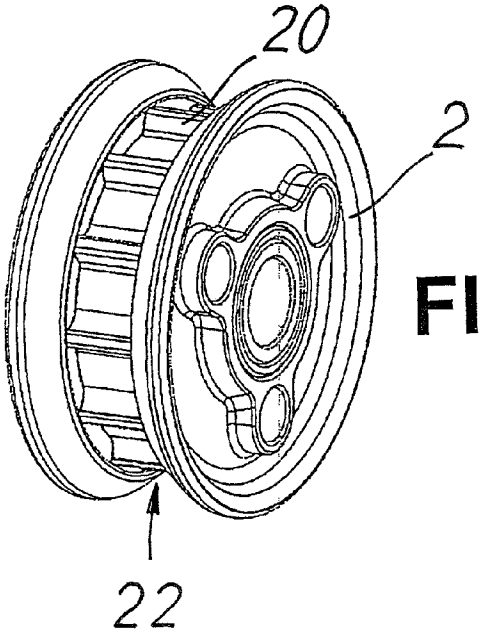

The invention is described below in the form of a preferred embodiment example, reference being made to the accompanying drawings in which FIG. 1 shows the device having the cleat in the top of a mast as seen from one side, FIG. 2 shows the interior of the device and the cleat in a perspective view, FIGS. 3-4 show on a greater scale said device and cleat according to an embodiment example, FIGS. 5-7 show an additional embodiment example of a device at a cleat and FIGS. 8-10 show different embodiment examples of the line sheave, which may be included in a device according to the invention.

GENERAL DESCRIPTION OF AN AUTOMATIC CLEAT ACCORDING TO THE PRESENT INVENTION

A new automatic cleat solves the problem of the sail sliding down due to strain in the halyard at the same time as the often occurring problems of failing trigger functions are avoided.

The cleat 1 consists of a cog-provided sheave 2, which the halyard 3 runs over. The sheave 2 rotates freely in both directions 7, 8 as long as the halyard 3 is unloaded or only moderately loaded. The halyard 3 is simultaneously running over a movable spring-loaded main arm 4, which gives a break of the halyard 3.

As the sail is hoisted by the fact that the line end 3A is pulled, the tension of the halyard 3 increases. When the tension of the halyard 3 is sufficiently high, the movable main arm 4 is pressed downward/rearward until a ratchet back stop part 21 engages the cogs 20 of the sheave and the sheave 2 transforms from being a sheave freely rotatable and in both directions 7, 8, into becoming a ratchet sheave having a ratchet back stop 5. The halyard/sail 9 can now be stretched up additionally with ratchet back stop function. When the sail 9 has reached the desired level one end 3A of the halyard 3 is belayed on deck level, e.g., in a rope-clutch.

The line 3 is arranged to directly co-operate with a movably actuatable mechanism 14, which is formed of at least one pivotably mounted main arm 4.

Said mechanism 14 is arranged to activate the ratchet back stop 5, the mechanism 14 being arranged to, upon fixed load of the line 3, 3A that goes down to deck and by means of which the sail 9 is hoisted, actuate the main arm 4 to connect ratchet back stop function 5 on the sheave 2 and in that connection prevent the pulling backwards 7 of the line toward the sail 9.

Thanks to cogs/grooves 20 in the sheave 2 and/or a wedge-shape of the sheave 2, the line 3 is prevented to slide in the blocked direction 7 and the line 3 is thereby locked. As long as a certain tension remains in the halyard end that goes down to deck, the halyard does not slide in the sheave and consequently the sail 9 will not be able to slither down. In order for the halyard 3 to be able to slide, a load of the sail 9 is required, which is many times the remaining load of the halyard end 3A, which goes down to deck. If, e.g., the halyard/sail is stretched up by 5000 N, an additional load of the sail is required by 15000 N before the line begins to slide and the sail slithers down—this if the locking/wedge action of the sheave is 1:4.

Upon taking in the sail, the halyard 3 is slackened on deck level. The tension of the halyard end 3A will then decrease until the spring-loaded arm $\mathbf{4}^1$ is enabled to move upward/forward so much that the part 21 of the ratchet back—stop 5 at the arm $\mathbf{4}^2$ goes out of its position. The sheave 2 then transforms back to become a sheave rotating freely in both directions 7, 8 and the sail slides down by its own weight.

In the event that the mechanics of the cleat 1 would fail and the ratchet back stop does not go out of position, the sail 9 can yet always be got down—however with great friction since the halyard 3 then has to slide over the cogged/grooved 20 and/or wedge-shaped sheave 2. The force in order to in such a position pull down the sail 9 could become 400 N if the tension of the halyard 3 due to friction and dead load is 10 kg, and if the locking/wedge action of the sheave 2 is 1:4.

Thus, by the fact that all locking mechanics is placed outside the sheave, in contrast to known 2,5 auto-ratchet blocks, greater dimensions are enabled of the mechanism and thereby greater loads than in previously known blocks.

The sheave and the ratchet mechanism act according to the present invention around a shaft each. The sheave is thereby separated from the ratchet mechanism in a way so that the sheave easily can be removed for, e.g., inspection or replacement.

According to the present device, what controls if the ratchet mechanism is active or not is a position displacement of THE LINE (substantially perpendicular to the direction of the line). In a so-called auto-ratchet block, it is instead a displacement of THE SHEAVE (substantially parallel to the line) which controls the ratchet mechanism.

By the fact that the ratchet mechanism now is situated externally, lower load on the ratchet cogs can be obtained.

If the ratchet cogs are enabled to abut against the line, it will maximally be the same load on the ratchet cogs as of the line, since the lever will be equal. If the ratchet teeth are enabled to lie on a greater diameter than the line (double gear rims on each side of the line), the load on the cogs becomes lower due to the fact that the lever is greater for the ratchet cogs than for the line.

In known auto-ratchet blocks according to the above mentioned, the ratchet cogs have to lie on a smaller diameter than the line, and therefore the load on the cogs exceeds the load of the line.

Description of Included Parts

Below, the included parts are described in an embodiment example where the cleat is placed in a top fitting and works as halyard cleat for a mainsail and divided arm is present.

The sheave 2 is provided with cogs 20, which also provide friction against the line 3 in blocked position.

A movable arm $4^1$ is kept in forward-folded/raised position by torsion spring 16 when "halyard down to deck" 3A is unloaded. Upon load of "halyard down to deck" 3A, arm $4^1$ is pressed downward/rearward.

Movable arm $4^1$ actuates movable arm $4^2$ when "halyard down to deck" is unloaded. By contact at $4^2$B between arm $4^1$ and arm $4^2$, arm $4^1$ brings away arm $4^2$, which is kept free from the cogs 20 of the sheave when "halyard down to deck" 3A is unloaded. When "halyard down to deck" 3A is loaded, arm $4^2$ moves inward toward the cogs 20 of the sheave and when contact at $4^2$B ceases, arm $4^2$ forms ratchet back stop, which moves independently of arm $4^1$.

When "halyard down to deck" 3A again is unloaded, contact finally arises again at $4^2$B, arm $4^1$ bringing arm $4^2$ with it in a motion away from the cog-provided sheave 2 and the ratchet braking function ceasing.

SPECIFIED DESCRIPTION OF THE INVENTION

A device 10 according to the present invention at cleat 1 for sailing boat in order to enable locking of a line 3 of a sail 9, a rig or something similar and where the line 3 is arranged to run over a sheave 2 on an elevated level 13 at a distance A from the deck of the sailing boat and having said cleat 1 for the locking of the line 3 situated at a distance from the deck of the boat, comprises a ratchet back stop 5 of the sheave 2 that is actuated by means of the line 3. According to this invention, the line 3 is arranged to run over a sheave 2, which is provided with ratchet back stop 5, where the line 3 is arranged to co-operate with a movably actuatable mechanism 14, which is arranged to actuate the ratchet back—stop 5 after co-operation with the vertically extending line part 3A.

Said mechanism 14 is arranged to, upon fixed load of "the line, which goes down to deck" 3A, connect ratchet back stop function 5 of the sheave 2 and in that connection prevent the pulling backwards of the line in the direction 7 down toward deck, and thereby also the motion of the sail going down to deck.

Said mechanism 14 is formed of at least one pivotably mounted main arm 4, which is spring force-actuated to aim at turning toward 15 downward line 3 and the part 3A thereof. (FIG. 7)

A spring 16 may in that connection be formed of a bent wire spring similar to such a spring that is found on resilient clothes pegs or clothespins. Also other types of springs may naturally be a possibility but in the example only a wire spring is shown, which with one end 25 thereof is fixedly clamped, for instance in a tightener 44 and with the free end 16B thereof co-operates with a preferably curvedly arched back-pressure plate 18 working as line pressure part of the arm 4. A said mechanism 14 and arm 4 may in that connection be divided and is then formed of two arm parts $4^1$, $4^2$ co-operating with each other. In that connection, an outer situated arm part $4^1$, counted from the sheave 2, and an inward turned arm part $4^1$A, are mounted turnable around a shaft 17. Said outer arm part $4^1$, is arranged to, upon overcoming the force F of the spring 16 toward the line 3, 3A, enable the inner arm part $4^2$ to cease to be in contact with the outer arm part $4^1$ at the portion $4^2$B and to, by the inward turned end portion $4^2$A thereof, activate the ratchet back stop 5 and by the part 21 thereof block the continued rotation of the sheave 2 around the mounting shaft 19 thereof in the direction 7 toward the sail.

Abutment co-operation between the line 3 and the main arm $4^1$ may take place by the fact that the outer end $4^1$B of the main arm $4^1$ has an abutment part 18 shape-adapted to the line 3 preferably in the form of a partly spherical concave plate, such as is shown in, e.g., FIG. 1, or as a mounted smaller reel, sheave etc.

The sheave 2, $2^1$, $2^2$ may preferably have a number of cogs 20, $20^1$, $20^2$, or other similar recesses or radially projecting portions evenly distributed along the circumference thereof. Said main arm $4^1$ has in that connection at least one ratchet back stop part 21 co-operatable with the respective cog 20, $20^1$, $20^2$, etc., in the form of, for instance, a tooth. A said ratchet back stop 5 is arranged to co-operate with the sheave 2, $2^1$, $2^2$, substantially tangentially in relation to the same toward the hoisting direction 8 of the sheave.

Common to the sheave 2, $2^1$, $2^2$ of the different embodiment examples is that it has a wedge-shaped inner line receipt part 22, $22^1$, $22^2$, and that it is arranged to, in unactuated state, be able to rotate freely around the mounting shaft 17 thereof in the two directions of rotation thereof, but upon actuation of the ratchet back stop 5 be arranged to be prevented from rotating in the back direction 8 and thereby become a so-called ratchet sheave of known type.

In FIG. 8, an example is shown of sheave 2 having cogs which also function as friction grooves. The cogs do not need be symmetrical. Here, the cogs are optimized for boom function on one side of each cog and formed for optimum friction against the line on the opposite side.

In FIG. 9, an example is shown of sheave $2^1$ according to the above but having wedge-shape for increased friction by wedge action. Movable arm formed in order to fit in the wedge shape.

In FIG. 10, an example is finally shown of a variant of sheave $2^2$ where the cogs for the ratchet back stop function have been separated from the friction-creating grooves. The cogs may here be given smaller spacing (more cogs), which makes that a ratchet brake is received having finer steps, almost a variable adjustment.

The entire arrangement with sheave and arm/arms is suitably received protectedly contained between the pair-wise disc-shaped part 23 of a top fitting of a mast 12 having spacers 24 between the parts 23 that are attached together, e.g., are riveted. In that connection, a pair of tighteners 44 in the form of, e.g., an adjustable holder arm, may be arranged tightenable on one of the top fitting parts 23. A fixed part 25 of the spring 16 is in that connection received in hole in the tightener 44 etc., which may change turning position after adjustment. By means of screw 26, the tightener 44 is tightened to the part 23 in different openings 27 therein. (FIG. 1). By means of a screw 26 or rivet, the position of the sheet-metal plate 44 is locked.

The function of the device 10 shown in, e.g., FIG. 4, at a cleat 1 is briefly again according to the following:

The sail is hoisted. The load of "halyard down to deck" is low. Torsion spring 16 holds arm $4^1$ in lowered position. By contact at point 28 between the arm $4^1$ and the arm end part $4^2$B, the arm $4^2$ is also kept in "off-position". No ratchet back stop function is obtained in that connection.

The sail in hoisted state. The load of "halyard down to deck 3A" has overcome the torque of the torsion spring 16. The ratchet back stop is in that connection in function by the effect of arm $4^2$. Arm $4^2$ works as ratchet back stop and can move independently of arm $4^1$. Torsion spring 50, which acts between arm $4^1$ and $4^2$, sees to it that arm $4^2$ all the time is lying and working as ratchet back stop. Additional load of "halyard end 3B coupled to sail" 9 entails no gliding in the direction 7 due to the friction between the line and the blocked sheave (up to a certain limit, which depends on the friction number between sheave and line).

Taking in the sail 9. The load of "halyard 3A down to deck" has decreased so much that the torque of torsion spring 16 has brought arm $4^1$ forward/upward. By contact at point 28, arm $4^2$ has been brought out of position and the ratchet back stop function has ceased. The sheave 2 now rotates freely in both directions 7, 8 and the sail 9 can be taken in as usual.

According to the embodiment of the device according to, among others, FIGS. 5-7, the function is according to the following:

A single arm 4 is in that connection only used and accordingly said arm 4 has the same function as the two arms $4^1$, $4^2$, of previous example have. Thus, in that connection the arm $4^2$ is lacking and the arm 4 now functions both as controlling element and ratchet.

The sail is hoisted. The load of "halyard down to deck" 3A is low. The torsion spring 16 holds arm 4 in lowered position. FIG. 5. No ratchet back stop function is obtained in that connection in said position I.

The sail in hoisted position II. The load of "halyard down to deck" 3A has overcome the torque of the torsion spring 16. Ratchet back stop in operation. Additional load of "halyard end coupled to sail" 3B entails no gliding due to the friction between line and the locked sheave (up to a certain limit, which depends on the friction number between sheave and line).

Taking in the sail. The load of "halyard down to deck" 3A has decreased so much that the torque of the torsion spring 16 has brought the arm 4 forward/upward and the ratchet back stop function has ceased. Position III. The sheave 2 now rotates freely in both directions 7, 8 and the sail can be taken in as usual.

Advantages in Relation to Existing Cleats

The sail is always possible to take in—no risk that the sail get stuck in locked position.

Trigger line is not needed.

No special or especially prepared line is needed.

No engagements in mast or rail are needed in contrast to "halyard cleat having jaws"

The locking is in principle variable in contrast to "halyard cleat having jaws"

Hoisting and taking in of sail is carried out in precisely the same way as when common sheave is used. (without halyard cleat)

All locking mechanics is placed outside the sheave in contrast to "auto-ratchet block", which enables greater dimensions of the mechanism and thereby greater loads.

The cleat functions as good for gearing halyard arrangement as for usual non-gearing.

Disadvantages in Relation to Existing Cleats

Wear of the halyard may arise when the halyard slides over the sheave in the transition from blocked to unblocked position.

Since the halyard cannot be allowed to be entirely unloaded, the mast compression is not reduced as much as in certain cleats.

However, the advantages obtained are so many more and more substantial than the few and small disadvantages that arise, in particular the safety aspect, which is advantage number one.

The invention is naturally not limited to the embodiments described above and shown in the accompanying drawings. Modifications are feasible, particularly as for the nature of the different parts, or by usage of equivalent technique, without departing from the protection area of the invention, such as it is defined in the claims.

The invention claimed is:

1. A device at a cleat for a sailing boat for detachably locking a line of a sail or a rigging, where the line runs over a sheave on an elevated level and the cleat for locking the line is situated at a distance from a deck of the boat, comprising the sheave having a ratchet back stop on the external sheave surface and a movably actuatable mechanism external to the sheave that includes at least one pivotably mounted main arm and that is arranged to activate the ratchet back stop when the line run over the sheave is under fixed load, the line directly engages the movably actuatable mechanism and thereby the movably actuatable mechanism contacts the ratchet back stop and prevents the sheave from rotating backward toward the sail or the rigging.

2. The device of claim 1, wherein the main arm is divided and formed of two arm parts that co-operate with each other.

3. The device of claim 2, wherein an outer spring force-actuated arm part is turnably mounted with an inward turned end portion around a shaft around which an inner arm part is turnably mounted, the outer arm part being arranged to enable, upon overcoming a force of the spring, the inner arm part to form ratchet back stop with the inward turned end portion thereof.

4. The device of claim 1, wherein the main arm is spring force-actuated in a downward hoisting direction of the line.

5. The device of claim 1, wherein the main arm is divided and formed of two arm parts that co-operate with each other.

6. The device of claim 5, wherein an outer spring force-actuated arm part is turnably mounted with an inward turned end portion around a shaft around which an inner arm pant is turnably mounted, the outer arm part being arranged to enable, upon overcoming a force of the spring, the inner arm part to form ratchet back stop with the inward turned end portion thereof.

7. The device of claim 1, wherein an outer end of the main arm has an abutment part that has a form of a concave plate or reel.

8. The device of claim 1, wherein the sheave has a number of cogs, recesses, or radially projecting portions distributed along the circumference of the sheave, and the main arm has a ratchet back stop part in a form configured to cooperate with the cogs, recesses, or radially projecting portions.

9. The device of claim 8, wherein the ratchet back stop is arranged to cooperate with the sheave substantially tangentially in relation to a hoisting direction of the sheave.

10. The device of claim 1, wherein the sheave has a wedge-shaped inner line receipt part, and is arranged to be able, in an unactuated state, to rotate freely in two directions, and to be prevented, upon actuation by the ratchet back stop, from rotating in a back direction, thereby acting as a ratchet sheave.

* * * * *